United States Patent [19]

Preston

[11] 4,296,555

[45] Oct. 27, 1981

[54] METHODS AND APPARATUS FOR CONDITIONING PLYWOOD VENEER WITH HIGH FREQUENCY RADIO ENERGY

[76] Inventor: Mark D. Preston, Meeting House Hill Rd., Mason, N.H. 03048

[21] Appl. No.: 113,659

[22] Filed: Jan. 21, 1980

[51] Int. Cl.[3] ..... F26B 3/34

[52] U.S. Cl. ..... 34/1; 34/13.8; 34/70; 34/143; 219/10.41; 219/10.73; 100/38; 100/93 P

[58] Field of Search ..... 34/1, 13.4, 13.8, 23, 34/70, 143, 145; 219/10.41, 10.81, 10.73, 10.69, 10.77; 100/38, 93 R, 93 P

[56] References Cited

U.S. PATENT DOCUMENTS 2,597,923 5/1952 Croston ..... 34/1

2,666,463 1/1954 Heritage ..... 34/1

3,721,013 3/1973 Miller ..... 34/1

3,986,268 10/1976 Koppelman ..... 34/1

*Primary Examiner*—Larry I. Schwartz

*Attorney, Agent, or Firm*—Maurice R. Boiteau

[57] ABSTRACT

There are disclosed in the present application, methods and apparatus for reprocessing sheets of veneer which have received an unsatisfactory first drying treatment resulting in wide variations in the percentage of moisture in various parts of a given sheet and in the average moisture from sheet to sheet. In the present apparatus, veneer sheets somewhat larger than four by eight feet are subjected in a stack or batch to radio frequency energy, heated air below the boiling point of water and variable pressure to accomplish both a redistribution of moisture and the elimination of excess moisture to prepare the sheets of veneer to be bonded together to form sheets of plywood.

15 Claims, 5 Drawing Figures

METHODS AND APPARATUS FOR CONDITIONING PLYWOOD VENEER WITH HIGH FREQUENCY RADIO ENERGY

The present invention relates generally to improvements in radio frequency or dielectric heating apparatus and methods and more particularly to such apparatus and methods which are applicable to the batch processing of plywood veneer.

In the manufacture of plywood, a first step consists in "peeling" veneer from logs and severing the veneer into appropriately sized sheets to be bonded together later to form plywood sheets. After being peeled, the veneer is passed in a single layer through a continuous feed drying oven in which heated air is directed against the veneer to dissipiate excess moisture. However, since no two sheets of veneer are alike, very substantial differences are encountered in the moisture content of sheets emerging from the oven. Even though the tolerance established for the moisture content of the oven treated veneer step product is as broad as feasible to assure the required quality of the finished product, a substantial percentage, on the order of ten to twenty-five percent fail to meet the acceptable limits. Typically, the sheets which are rejected tend to contain an excessive amount of moisture and also to include wide variations in moisture content in different parts of the same sheet. Thus, a typical sheet may have large spots in which the moisture content is as high as twenty-five percent of the dry weight of the wood, whereas other spots are nearly completely dry.

The conventional practice for salvaging such excessively moist and non-uniformly dried sheets of veneer is to segregate them by inspection as they emerge from the oven and then when a sufficient quantity has been accumulated, to hand feed them for a second pass through the oven. This approach, however, has not been entirely satisfactory for a number of reasons. During the second pass through the oven, previously processed veneer sheets tend to become excessivly dry and brittle in areas which were adequately dried during the first pass. The result is that the excessively dry surface areas are the cause of substantial scrap due to breakage. Another result is that these same areas become "case hardened" during the second pass and will not accept the adhesive used in a later manufacturing step for laminating a plurality of veneer sheets together to form plywood sheets. In addition, while some spots on a veneer sheet may be excessively dry, other areas of the same sheet may continue to retain excessive moisture through the second pass and later fail to form an adequate bond as the excess moisture turns to steam during the laminating process. Costs associated with the conventional salvaging process are also considerable and include not only substantial labor but also a sizable quantity of veneer scrap produced during attempts to salvage and some downgrading of finished product. In addition, energy costs associated with the inefficiency of the ovens during second pass treatment cannot be dismissed as inconsequential.

It is accordingly an object of the present invention to improve the uniformity of moisture content in veneer step products to be converted into plywood.

A more general object is to achieve economies of both labor and materials in the manufacture of plywood.

Another general object is to improve the overall quality of plywood products at the same time that the cost of manufacture is reduced.

In the achievement of the foregoing objects, a feature of the invention relates to the use of electrodes which not only subject a stack of veneer sheets to radio frequency energy but also control the interface flow of water and steam. For this purpose, a stack of veneer sheets which have previously been dried in an unsatisfactory manner is placed between electrodes which perform the dual functions of applying radio energy to the stack and also of subjecting the stack to variable pressure. At the beginning of the operating cycle, while the veneer is wettest, it absorbs maximum r. f. energy and at the same time it is also subjected to maximum pressure from the electrode. According to a related feature of the invention, the average moisture content of the stack of veneer is continuously sensed and when it has dropped to a predetermined level, the pressure is reduced for a final period of treatment. Then, when the average moisture has been reduced further and an optimum moisture content has been reached, the power is turned off and a signal is sounded to indicate that the treatment cycle has been completed.

The foregoing objects and features of the invention together with numerous advantages flowing from its use will be more fully understood and appreciated from the following detailed description of an illustrative embodiment of both an apparatus and a method, taken in connection with the accompanying drawings in which.

Figure 1:
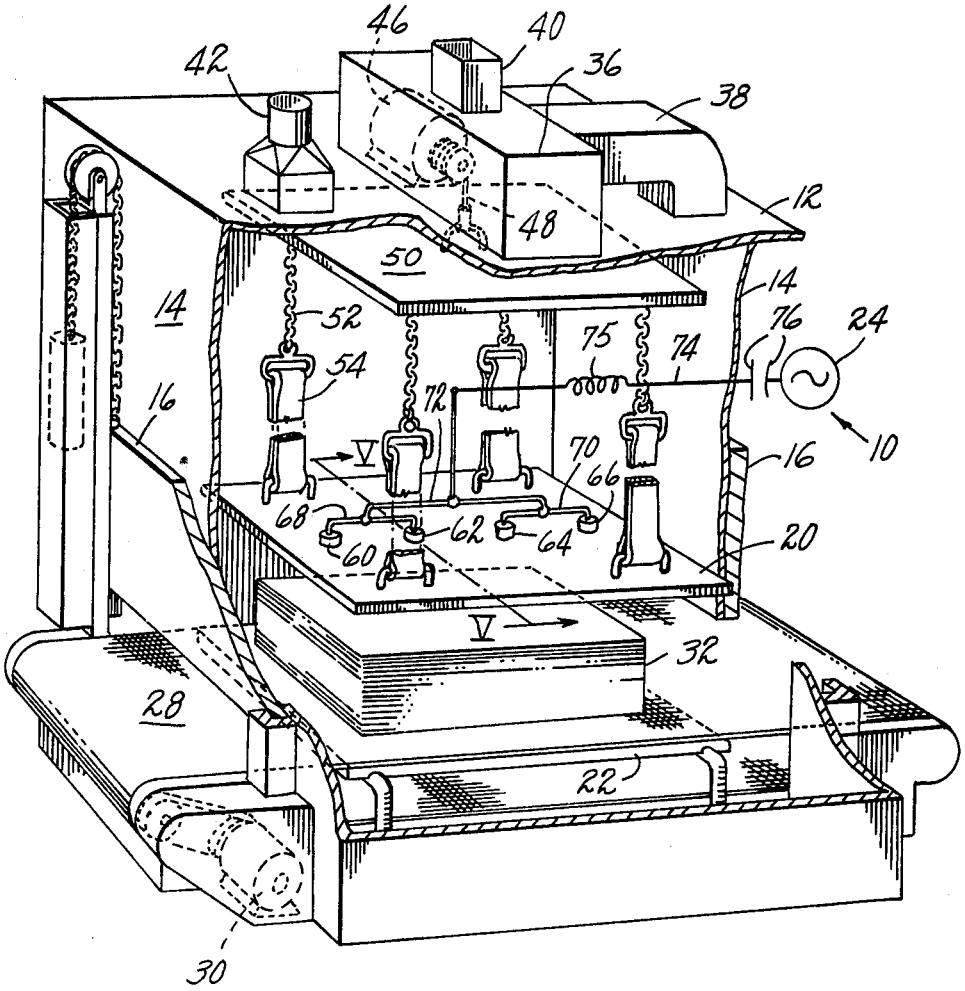
FIG. 1 is a view in perspective and partly in cross-section showing apparatus according to the invention which is useful for carrying out the methods of the present invention.

Turning now to the drawings, particularly FIG. 1, there is shown a cabinet or enclosure indicated generally at 10 and including a top wall 12 and end walls 14, each having an opening closed by a counterweighted door 16. Inside the cabinet 10 are upper and lower electrodes 20 and 22, connected to a radio frequency oscillator 24 of generally conventional design. There is also provided a conveyor belt 28 driven by an electric motor reducer 30 and passing over the lower electrode 22 to introduce bundles or stacks 32 of veneer sheets into operative position between the electrodes 20 and 22. As is seen in the drawings, the electrodes 20 and 22 extend approximately one foot beyond each edge of the bundle of veneer sheets. Thus, for operating on sheets which are four by eight feet, the electrodes are approximately six by ten feet. The purpose of this extension of the electrodes beyond the edges of the veneer sheets will hereinafter be explained in detail.

Air inside the cabinet 10 is heated to a temperature in the range of 170 to 210 degrees Farenheit and continuously circulated by a blower (not shown) contained within a penthouse 36 on top of the cabinet 12 and connected by a duct 38 with the interior of the cabinet. Both the blower and its associated motor are of conventional design as is the source of heat for the circulating air. An intake 40 is mounted on top of the penthouse 36 and is in communication with the blower on the inside while an air exhaust chimney 42 also extends from the top of the cabinet and is in communication with its interior. The chimney 42 is provided with its own motor driven fan (not shown) which may be thermostatically controlled to assist in regulating the temperature of the air inside the cabinet 12. It is preferable that the air temperature inside the cabinet be maintained below the boiling point of water so as to avoid surface deterioration of the plywood veneer caused by excessive heat but its temperature should be as high as possible to absorb maximum moisture liberated from the stack of veneer 32 under the influence of the radio frequency energy.

The electrode 20 is made of thick material, preferably heavy electrically conductive material and may additionally be weighted or assisted by air or hydraulic cylinders for applying pressure to the stack 32. There is provided a mechanism for lifting the plate 20, including a motor operated winch connected by a cable 48 to the center of a rectangular lifting plate 50. The electrode 20 is interconnected at each of its corners to the related corner of the plate 50 by a combination of a chain 52 and a high tensile strength insulating strap 54. The winch 46 is controlled for raising and lowering the plate 50 and the electrode 20, either by a manually operated switch for loading and unloading a stack of plywood venner, or automatically during the operating cycle in response to reaching a predetermined degree of average dryness.

Figure 3:
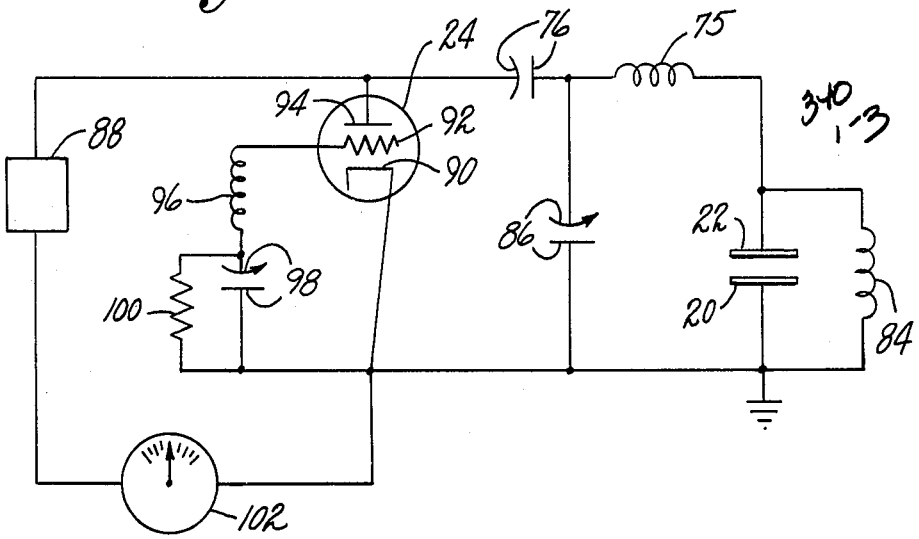
FIG. 3 is a simplified schematic diagram showing connections between a radio frequency energy source and electrodes for applying the energy to workpieces and also circuits for controlling auxilliary functions during the operation of the apparatus.

Voltage distribution between the electrodes 20 and 22 is not uniform but is designed to be higher at the edges of the electrodes due to the presence of standing waves. Although the oscillator may operate in a wide range of frequencies from 10 to 100 megahertz (MHz), the preferred operating frequency is 27 MHz. At that frequency, the preferred voltage distribution is obtained by providing four equally spaced connections 60, 62, 64 and 66 to the electrode 20 and grounding the electrode 22. Adjacent connections 60 and 62 are joined electrically by a stub 68 while the connections 64 and 66 are similarly joined by a stub 70. The central points of the stubs 68 and 70 are interconnected by a link 72 to the center of which a feed line 74 is connected to link the electrode 20 to the oscillator 24. As also seen in FIG. 3, an inductance 75 in the line 74 represents the lumped inductance of the circuit and a d. c. blocking condenser 76 is interposed in the line 74. An inductance 84 and a variable capacitor are connected in parallel with the electrodes 20 and 22 to provide a tuned load for the oscillator 24. A power supply 88 is provided for the oscillator 24 which is shown as a triode including a cathode 90, a grid 92 and a plate 94. A tuned circuit comprising an inductance 96 in series with a variable capacitor 98 is connected to the grid 92. A resistor 100 is connected in parallel with the capacitor 98 and an optical meter relay 102 is interposed between the cathode 90 and the negative side of the power supply 88. The relay 102 is of the double set point type which is commercially available and in the present circuit performs the function of sensing the quantity of moisture in the stack of veneer 32 by reacting to changes in the plate current of the oscillator 24. This is possible because of the fact that dry wood has a much lower power loss factor than either water or steam. Accordingly, as the average moisture in the veneer is reduced by the action of the radio frequency energy on the stack of veneer during the operating cycle of the apparatus, the plate current is reduced. When a first predetermined moisture level is reached a set of contacts closes in the relay 102, causing a secondary relay (not shown) to be energized. The secondary relay includes contacts which perform the function of reducing the pressure applied to the stack of veneer 32 by closing a switch which energizes the motor 46 to raise the electrode 22 a slight predetermined distance. As the moisture content of the veneer is further reduced under the influence of the r. f. energy, the predetermined final moisture content of the veneer is reached and this is sensed as a lower level of plate current which causes a second set of contacts on the relay 102 to close thereby energizing another secondary relay (also not shown) to terminate the operating cycle of the apparatus by cutting off the plate voltage to the oscillator. In addition there is also a signal to the operator that the cycle has been completed so that he may remove the treated stack and start the processing of a new stack.

While maximum pressure is applied to the stack 32, there is a sealing effect by the edges of the veneer sheets which limits the escape of water vapor and steam from between the sheets. The result is that steam and water vapor trapped between the sheets tend to follow the path of least resistance along the length of the veneer grain and thus to condition the sheets over their entire surfaces by removing moisture from wet areas and depositing it in areas which were overdried during their prior treatment. The application of radio frequency energy by the present apparatus is not uniform because of the standing waves which impress uneven voltages over the area of the electrodes and also because of the fact that due to differences in the power loss factor of dry wood as opposed to water, the greatest power level is effectively impressed upon the wettest areas and the least upon the driest areas. Thus, not only is there a diffential application of energy to different areas of the stack, but there is also a redistribution of moisture from wet to dry areas during the initial period of the cycle. With the moisture redistributed, and the pressure relieved at the start of the latter portion of the operating cycle, the absorption of energy by the veneer is more nearly uniform and the steam and water vapor are allowed to escape from between the sheets of veneer and to be picked up and carried out by the heated air being circulated through the cabinet 10 by the blower.

Figure 4:
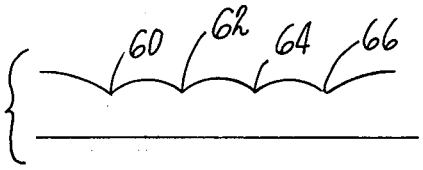
FIG. 4 is a diagrammatic showing of the distribution of radio frequency voltage along the longitudinal center line of the electrodes.
Figure 5:
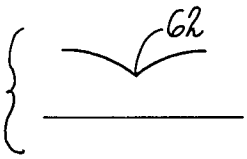
FIG. 5 is a diagrammatic showing similar to FIG. 4 but depicting the distribution of radio frequency voltage between the electrodes in a transverse plane along the line VV of FIG. 1.

The spacing of the connections 60, 62, 64 and 66 together with the dimensions of the stubs 68, 70 and the link 72 are designed to produce standing waves in which a maximum voltage is applied between the edges of the electrodes 20 and 22 as seen in in FIGS. 4 and 5.

Figure 2:
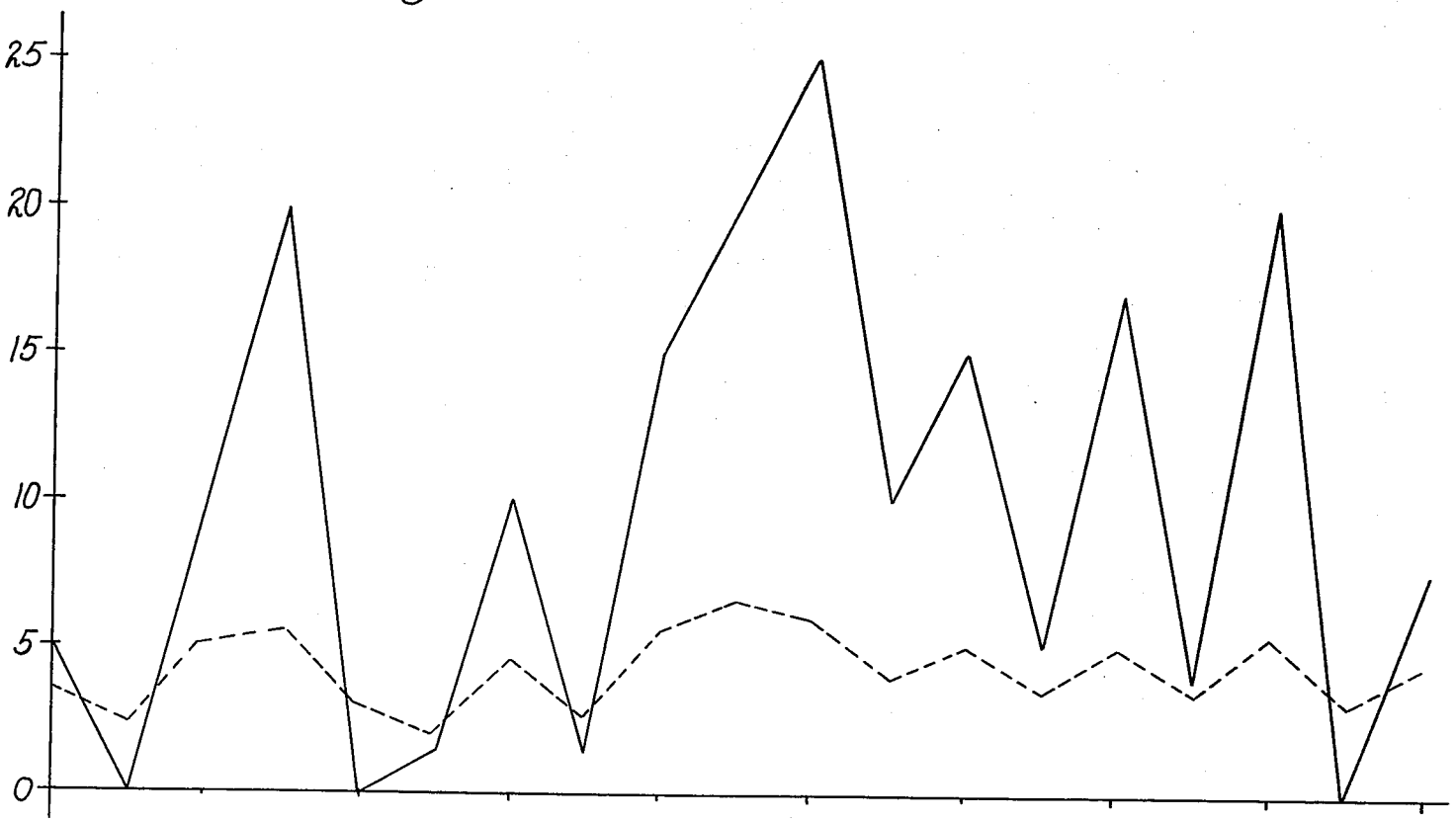
FIG. 2 is a graphic representation of initial and eventual moisture content measurements at separated locations in a typical plywood veneer sheet.

There is shown in a solid line in FIG. 2, a graphic representation of a typical sheet of veneer which has been set aside for reprocessing because of both uneven moisture distribution and excessive moisture in some areas. The range of moisture content as measured at random locations is seen to vary from a peak of approximately 25% in one location, 20% in two locations and zero in three locations. After treatment in the present apparatus, the moisture content at the same locations is shown by the dotted line of FIG. 3 to be confined to very close limits, approximately five to seven percent.

It will be seen from the foregoing that treatment of plywood veneer with the apparatus and in accordance with the methods which have been described above will result in substantial savings of time and materials and also appreciably improve the quality of the resultant plywood product by avoiding the inclusion of locally weakened layers of veneer in the finished plywood. Some of the benefits may accrue from the use of just a part of the present methods and apparatus including some but not all of the features. Many variations and modifications of the present methods and apparatus will immediately become apparent to those of ordinary skill in the art. It is therefore not intended that the specification be construed as a limitation of the scope of the invention but rather that it be interpreted in terms of the appended claims.

Having thus disclosed my invention, what I claim as new and desire to secure by Letters Patent of the United States is:

1. A method of conditioning a multiplicity of sheets of veneer in a batch comprising the steps of arranging the sheets in a stack, placing the stack between a pair of electrodes, applying a predetermined pressure to the stack between the electrodes, applying radio frequency energy to the electrodes, sensing changes in moisture content of the stack under the influence of the radio frequency energy, partially relieving the pressure in response reaching a predetermined level of moisture content and continuing the application of radio frequency energy to the electrodes.

2. A method according to claim 1 further comprising the step of continuing the sensing of the moisture content after the pressure has been partially released.

3. A method according to claim 2 further comprising the step of terminating the conditioning in response to sensing a predetermined moisture level after the pressure has been partially released.

4. A method according to claim 1 further comprising the step of directing heated air against the stack while it is being subjected to radio frequency energy.

5. A method according to claim 4 further comprising the step of enclosing the electrodes and the stack and providing an exhaust for moisture vapor.

6. Apparatus for conditioning a multiplicity of sheets of veneer in a batch comprising a pair of electrodes, a source of radio frequency energy connected to the electrodes, means for applying pressure to a stack of veneer sheets placed between the electrodes, means for sensing the moisture content of the stack of veneer and means for partially relieving the pressure on the stack while continuing the application of radio frequency energy to the electrodes, in response to reaching a first predetermined moisture level.

7. Apparatus according to claim 6 further comprising means for continuing to sense the moisture content after the pressure has been partially released.

8. Apparatus according to claim 7 further comprising means for terminating a treatment cycle in response to reaching a second predetermined moisture level.

9. Apparatus according to claim 6 further characterized in that the means for applying radio frequency energy to the electrodes includes an oscillator and that the moisture content sensing means reacts to changes in plate current of the oscillator.

10. Apparatus according to claim 6 further comprising an enclosure in which the electrodes are mounted and means for in introducing heated air into the enclosure.

11. Apparatus according to claim 6 further characterized in that the electrodes are in the form of plates one above the other and further comprising means for raising the upper electrode a predetermined slight distance for relieving the pressure.

12. A method of conditioning a multiplicity of sheets of veneer in a batch comprising the steps of arranging the sheets in a stack, placing the stack between a pair of electrodes, applying a predetermined pressure to the stack between the electrodes, applying radio frequency energy to the electrodes, sensing changes in moisture content of the stack under the influence of the radio frequency energy, relieving the pressure in response to reaching a predetermined level of moisture content and continuing the sensing of the moisture content after the pressure has been released.

13. A method according to claim 12 further comprising the step of terminating the conditioning in response to sensing a predetermined moisture level after the pressure has been released.

14. Apparatus for conditioning a multiplicity of sheets of veneer in a batch comprising a pair of electrodes, a source of radio frequency energy connected to the electrodes, means for applying pressure to a stack of veneer sheets placed between the electrodes, means for sensing the moisture content of the stack of veneer, means for relieving the pressure on the stack in response to reaching a predetermined moisture level and means for continuing to sense the moisture content after the pressure has been released.

15. Apparatus according to claim 14 further comprising means for terminating a treatment cycle in response to reaching a predetermined moisture level.

* * * * *